US010465573B2

(12) United States Patent
Sugihira et al.

(10) Patent No.: US 10,465,573 B2
(45) Date of Patent: Nov. 5, 2019

(54) INTERNAL COMBUSTION ENGINE SYSTEM

(71) Applicant: TOYOTA JIDOSHA KABUSHIKI KAISHA, Toyota-shi, Aichi-ken (JP)

(72) Inventors: Shigehiro Sugihira, Susono (JP); Noriyasu Adachi, Numazu (JP); Keisuke Sasaki, Susono (JP); Takayoshi Kawai, Susono (JP); Kaoru Otsuka, Mishima (JP); Shinji Sadakane, Susono (JP); Hiroyuki Sugihara, Shizuoka-ken (JP)

(73) Assignee: TOYOTA JIDOSHA KABUSHIKI KAISHA, Toyota-shi, Aichi-ken (JP)

( * ) Notice: Subject to any disclaimer, the term of this patent is extended or adjusted under 35 U.S.C. 154(b) by 0 days.

(21) Appl. No.: 15/888,563

(22) Filed: Feb. 5, 2018

(65) Prior Publication Data

US 2018/0230869 A1 Aug. 16, 2018

(30) Foreign Application Priority Data

Feb. 16, 2017 (JP) ..... 2017-027090

(51) Int. Cl.
*F01L 1/34* (2006.01)
*F01L 13/00* (2006.01)
*F01L 1/08* (2006.01)

(52) U.S. Cl.
CPC ..... *F01L 13/0036* (2013.01); *F01L 1/08* (2013.01); *F01L 13/00* (2013.01); *F01L 2013/0052* (2013.01); *F01L 2800/01* (2013.01); *F01L 2800/03* (2013.01); *F01L 2800/11* (2013.01)

(58) Field of Classification Search
CPC . F01L 1/08; F01L 13/0036; F01L 2013/0052; F01L 2800/01; F01L 2800/03; F01L 2800/11
USPC ..... 123/90.16, 90.18, 90.6
See application file for complete search history.

(56) References Cited

U.S. PATENT DOCUMENTS 10,030,596 B2 * 7/2018 Sugihara ..... F01L 13/0036 123/90.15
2002/0029757 A1 3/2002 Ogawa et al.
2010/0269769 A1 10/2010 Schoeneberg et al.
2014/0165939 A1 6/2014 Ito et al.
2015/0034030 A1 2/2015 Schnoelzer et al.
(Continued)

FOREIGN PATENT DOCUMENTS

DE 102012006820 A1 10/2013
EP 1489271 B1 7/2008
(Continued)

*Primary Examiner* — Ching Chang
(74) *Attorney, Agent, or Firm* — Sughrue Mion, PLLC

(57) ABSTRACT

In a system that selects a large-cam as a driving cam at a time of a start of an engine, when an engine stop request is output, it is determined whether there is a small-cam cylinder for which a small-cam is selected as the driving cam. In a case where it is determined that there is a small-cam cylinder, a switching command for switching the driving cam from the small-cam to the large-cam is output. When an engine start request is output, the above determination is performed again. In a case where it is determined that there is a small-cam cylinder, the switching command is output to all solenoid actuators again. In addition, the drive of the fuel injector is suspended until the switching operation of the driving cam is completed for all cylinders.

3 Claims, 8 Drawing Sheets

(56) References Cited

U.S. PATENT DOCUMENTS

| | | | |
|---|---|---|---|
| 2016/0108834 | A1 | 4/2016 | McConville |
| 2016/0333803 | A1 | 11/2016 | Davis et al. |

FOREIGN PATENT DOCUMENTS

| | | | |
|---|---|---|---|
| EP | 2 199 581 | A1 | 6/2010 |
| EP | 2 743 479 | A1 | 6/2014 |
| JP | 2003-161192 | A | 6/2003 |
| JP | 2009-228543 | A | 10/2009 |
| JP | 2010-168966 | A | 8/2010 |
| JP | 5404427 | B2 | 11/2013 |
| WO | 2013/021749 | A1 | 2/2013 |

* cited by examiner

INTERNAL COMBUSTION ENGINE SYSTEM

INCORPORATION BY REFERENCE

The disclosure of Japanese Patent Application No. 2017-027090 filed on Feb. 16, 2017 including the specification, drawings and abstract is incorporated herein by reference in its entirety.

BACKGROUND

1. Technical Field

The disclosure relates to an internal combustion engine system.

2. Description of Related Art

Japanese Patent No. 5404427 discloses a valve operating device including a cam carrier that is provided on a camshaft of an engine and a servomechanism that slides the cam carrier in an axial direction of the camshaft. The cam carrier includes three kinds of cams that have different cam profiles and that are capable of driving an intake valve. On an outer peripheral surface of the cam carrier, a groove having a predetermined shape is formed. The groove having the predetermined shape includes an inclined portion that is inclined with respect to the axis of the camshaft. The servomechanism operates so as to push out an engagement element capable of engaging with the groove on the cam carrier, from a predetermined retraction position, or to return the engagement element to the predetermined retraction position. When the servomechanism is actuated during the rotation of the camshaft, the engagement element is moved along the groove on the cam carrier. When the engagement element is moved along the above-described inclined portion, the cam carrier is slid in the axial direction of the camshaft. According to such a valve operating device, it is possible to switch a cam that drives the intake valve (hereinafter, referred to as a "driving cam"), to a desired cam, at a desired timing.

SUMMARY

Incidentally, in the case where the engine that uses the above-described switching of the driving cam is a multiple cylinder engine, cam profiles of driving cams of all cylinders are generally equalized to an identical cam profile. If a single cam carrier shared by all cylinders is provided on the camshaft, the cam profiles of all driving cams are concurrently equalized to an identical cam profile. Otherwise, that is, if the cam carrier is provided for each corresponding cylinder or for each corresponding cylinder group, the cam profiles of the driving cams are switched in order, separately by each cam carrier.

At the time of the start of the multiple cylinder engine, it is desired that the cam profiles of all driving cams be equalized to a cam profile suitable for the start (hereinafter, referred to as a "start profile"). However, in the case where the cam carrier is provided for each corresponding cylinder or for each corresponding cylinder group, there is a possibility that the combustion state of a cylinder for which the change to the start profile is not completed becomes unstable, when the change to the start profile is performed in parallel with the start of the engine. Further, there is also a possibility that the combustion state varies between a cylinder for which the change is completed and a cylinder for which the change is not completed. Therefore, the change to the start profile is desired to be completed by the start of the engine, and moreover, is desired to be completed by the time of the previous stop of the engine. However, the change to the start profile does not necessarily succeed at the time of the previous stop.

If the engine is started in a state where some cam carriers have failed in the change to the start profile at the time of the previous stop, the above-described problems relevant to the combustion state occur. As a measure against this problem, at the time of the previous stop, the stop of the engine may be extended until the change to the start profile is completed. However, when the stop of the engine is extended, there is a problem in that fuel consumption increases by an amount equivalent to the extension. Further, there are various modes for the stop of the engine, and in some cases, the extension of the stop of the engine is originally impossible. That is, in the case of an unexpected engine stop that is not based on a driver's intention or a control by an in-vehicle computer, there is a problem in that the change to the start profile is impossible at the time of the previous stop.

The disclosure has been made in view of the above-described problems. That is, an object of the disclosure is to prevent problems of the combustion state at the time of the start of the engine, in a multiple cylinder engine system in which the switching among a plurality of kinds of cams having different cam profiles is performed by a cam carrier provided for each corresponding cylinder or for each corresponding cylinder group.

An aspect of the disclosure relates to an internal combustion engine system. The internal combustion engine system includes an internal combustion engine that includes a plurality of cylinders, a plurality of kinds of cams that have different cam profiles, each of the plurality of kinds of cams being configured to be capable of driving an intake valve that is provided for each of the cylinders of the internal combustion engine, a plurality of cam carriers, a plurality of switching mechanisms, and a controller. Each of the plurality of cam carriers is configured to support the plurality of kinds of cams provided for a corresponding one of the cylinders or to support the plurality of kinds of cams provided for a corresponding one of cylinder groups. The plurality of cam carriers is provided on a camshaft which rotates in synchronization with a crankshaft of the internal combustion engine. Each of the plurality of switching mechanisms is respectively provided for a corresponding one of the cam carriers. The plurality of switching mechanisms switches driving cams among the plurality of kinds of cams. Each of the driving cams is a cam that actually drives the intake valve. The controller is configured to output a switching command, for performing switching of the driving cam of each cylinder to a predetermined start cam, to the switching mechanism at a time of a stop of the internal combustion engine. The controller is configured to output the switching command to the switching mechanism, when a failure of the switching to the predetermined start cam has occurred, at a time of a next start of the internal combustion engine. The controller is configured to suspend a start of combustion of air-fuel mixture in each cylinder, until the switching is completed for all cylinders.

The plurality of switching mechanisms may respectively slide the cam carriers in the axial direction of the camshaft in order, by extruding pins capable of engaging with the cam carriers.

According to the aspect, even in the case of the failure of the switching to the start cam at the time of the stop of the internal combustion engine, it is possible to perform the switching to the start cam at the time of the next start of the internal combustion engine, and to suspend the start of the combustion of the air-fuel mixture in each cylinder, until the switching is completed for all cylinders. That is, it is possible to start the combustion of the air-fuel mixture in each cylinder, after the switching to the start cam is completed for all cylinders at the time of the next start of the internal combustion engine. Accordingly, it is possible to prevent problems of the combustion state at the time of the next start of the internal combustion engine.

The controller may be configured to specify a specified cylinder or a specified cylinder group at the time of the stop of the internal combustion engine and output the switching command only to the switching mechanism provided corresponding to the specified cylinder or the specified cylinder group at the time of the next start of the internal combustion engine. The specified cylinder is a cylinder that has failed to switch to the predetermined start cam. The specified cylinder group is a cylinder group that includes a cylinder that has failed to switch to the predetermined start cam.

According to the aspect, at the time of the next start of the internal combustion engine, it is possible to perform the switching to the start cam, only for the corresponding cylinder or corresponding cylinder group that has failed to switch to the start cam at the time of the stop of the internal combustion engine. Accordingly, it is possible to suppress the amount of electric power to be consumed for the drive of the switching mechanism, compared to the case where the switching to the start cam is performed for all cylinders.

The internal combustion engine system may further include an electric motor that rotates the crankshaft. The controller may be configured to specify a specified cylinder or a specified cylinder group at the time of the stop of the internal combustion engine and control the electric motor during a period when the internal combustion engine is stopped such that an order for the specified cylinder or the specified cylinder group is advanced. The order is an order of the switching to the predetermined start cam at the time of the next start of the internal combustion engine. The specified cylinder is a cylinder that has failed to switch to the predetermined start cam. The specified cylinder group is a cylinder group that includes a cylinder that has failed to switch to the predetermined start cam.

According to the aspect, it is possible to advance the order of the switching to the start cam at the time of the next start of the internal combustion engine, for the corresponding cylinder or corresponding cylinder group that has failed to switch to the start cam at the time of the stop of the internal combustion engine. Accordingly, it is possible to shorten a suspension time of the combustion of the air-fuel mixture in each cylinder at the time of the next start of the internal combustion engine, and to complete a start operation early.

BRIEF DESCRIPTION OF THE DRAWINGS

Features, advantages, and technical and industrial significance of exemplary embodiments of the disclosure will be described below with reference to the accompanying drawings, in which like numerals denote like elements, and wherein.

DETAILED DESCRIPTION OF EMBODIMENTS

Figure 1:
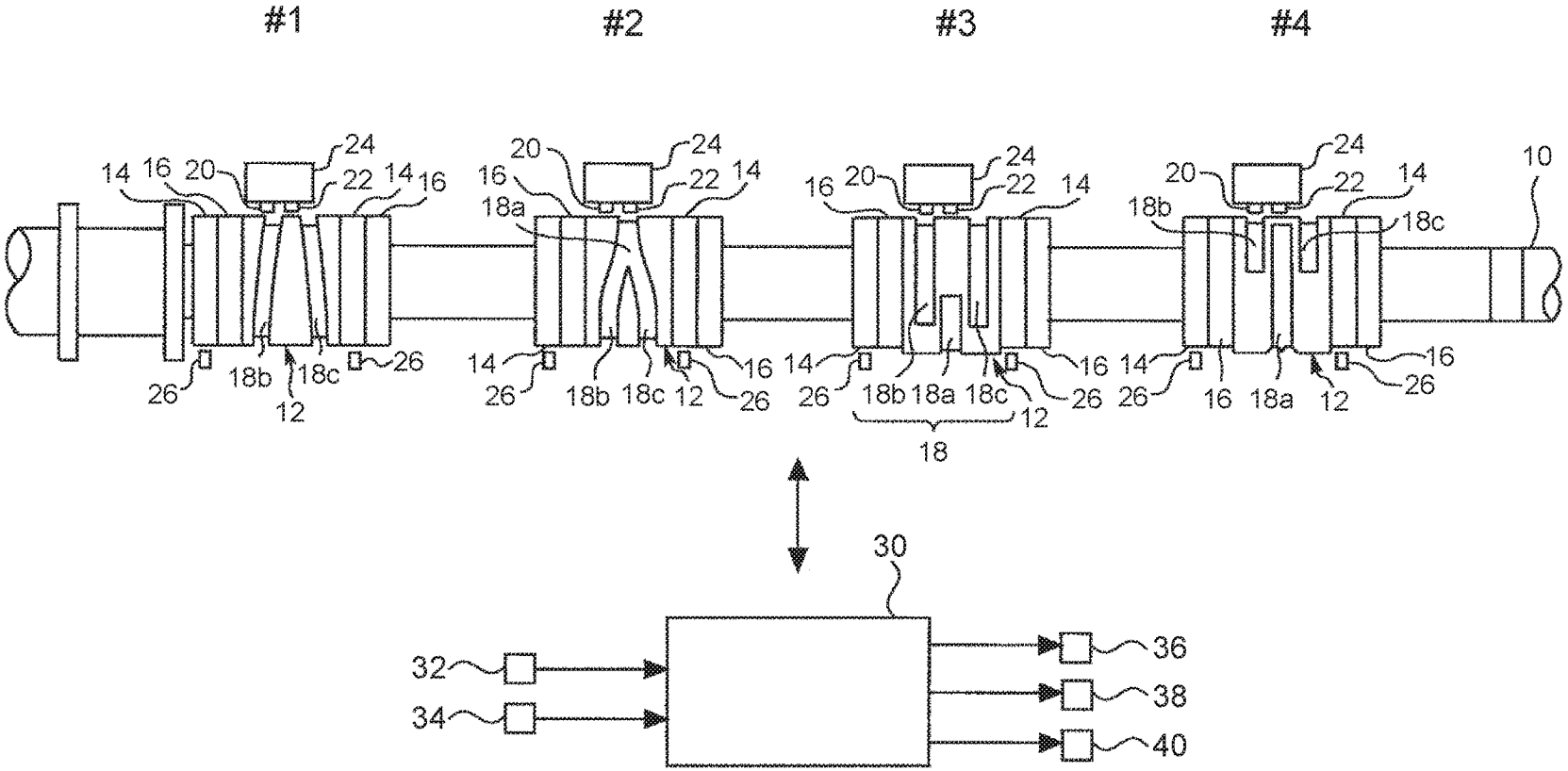
FIG. 1 is a schematic diagram showing an exemplary configuration of a system according to a first embodiment of the disclosure.

Hereinafter, embodiments of the disclosure will be described based on the drawings. In the drawings, identical reference characters are assigned to common elements, and repetitive descriptions are omitted. The disclosure is not limited to embodiments described below.

To begin, a first embodiment of the disclosure will be described with reference to FIGS. 1 to 5.

FIG. 1 is a schematic diagram showing an exemplary configuration of a system according to the first embodiment of the disclosure. The system shown in FIG. 1 is a system of an internal combustion engine that is mounted on a vehicle. The internal combustion engine is a four-stroke reciprocating engine, and is an inline-four engine. The firing order of the engine is the order of a number one cylinder #1, a number three cylinder #3, a number four cylinder #4 and a number two cylinder #2. The number of the cylinders of the engine may be two, may be three, or may be five or more. Further, the firing order of the engine is not particularly limited.

A valve train shown in FIG. 1 includes a camshaft 10. The camshaft 10 is connected to a crankshaft (not illustrated) of the engine, and rotates in synchronization with the crankshaft. On the camshaft 10, four cam carriers 12 formed as hollow shafts are disposed. Each cam carrier 12 is fixed in a rotational direction of the camshaft 10, and is slidably disposed in an axial direction of the camshaft 10. The cam carrier 12 includes two kinds of intake cams 14, 16 having different cam profiles (the cam profile means at least one of lift amount and valve duration; the same applies hereinafter), in an adjacent manner. Note that "valve duration" means the length of time, in degrees, that a valve is held open.

In the first embodiment, the intake cam 14 has a smaller valve duration and lift amount than the intake cam 16. Hereinafter, for the purpose of explanation, an intake cam having a relatively small valve duration and lift amount is referred to as a "small-cam", and an intake cam having a relatively large valve duration and lift amount is referred to as a "large-cam". Two sets of small-cams 14 and large-cams 16 are included for each cylinder. The reason is that two intake valves are provided for each cylinder. However, in the disclosure, the number of intake valves for each cylinder may be one, or may be three or more.

Spiral grooves 18 are formed on surfaces of the cam carriers 12. Each of the spiral grooves extends so as to rotate in the axial direction of the camshaft 10. The grooves 18 are formed with phase differences among the cylinders. Specifically, a phase difference of 90° is provided between the groove 18 on the number one cylinder #1 and the groove 18 of the number three cylinder #3, between the groove 18 of the number three cylinder #3 and the groove 18 of the number four cylinder #4, between the groove 18 of the number four cylinder #4 and the groove 18 of the number two cylinder #2, and between the groove 18 of the number two cylinder #2 and the groove 18 of the number one cylinder #1. In the groove 18 of each cylinder, two branches are merged to one groove. Hereinafter, to distinguish the sites of the groove 18, a groove 18 after merging is referred to as a groove 18*a*, and two grooves 18 before merging are referred to as grooves 18*b*, 18*c*. The depth of the groove 18*a* is not constant, and in a range from an intermediate portion to an end portion, the groove 18*a* is formed such that the depth is smaller at a position closer to the end portion.

The valve train shown in FIG. 1 includes, for each cylinder, a solenoid actuator 24 including two pins 20, 22 and two coils (not illustrated). The pins 20, 22 are composed of a magnetic substance. When the coil is energized, the pin 20 (or the pin 22) is extruded from the solenoid actuator 24. When the pin 20 (or the pin 22) is extruded, the pin 20 (or the pin 22) is inserted into the groove 18*b* (or the groove 18*c*), so that the pin 20 (or the pin 22) engages with the groove 18.

When the pin 20 (or the pin 22) engaging with the groove 18 is pushed by the small-depth end portion of the groove 18*a*, the pin 20 (or the pin 22) is pushed back to the solenoid actuator 24 side. When the pin 20 (or the pin 22) is pushed back to the solenoid actuator 24 side, induced electromotive force is generated because electric current flows through the coil. When the induced electromotive force is detected, the energization of the coil is cut off. When the energization of the coil is cut off, the pin 20 (or the pin 22) is drawn to the solenoid actuator 24, and the pin 20 (or the pin 22) is disengaged from the groove 18. Hereinafter, when the pins 20, 22 need not be particularly distinguished, the pins 20, 22 are referred to as merely "pins".

Figure 2A:
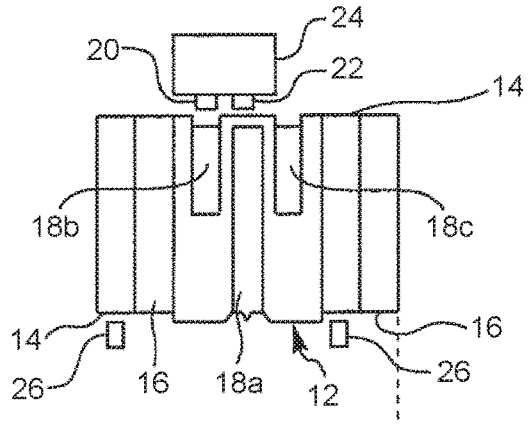
FIGS. 2A to 2D are diagrams for describing an exemplary rotating operation of a cam carrier 12 by engagement between a pin 20 and a groove 18 shown in FIG. 1.

FIGS. 2A to 2D are diagrams for describing an exemplary rotating operation of the cam carrier 12 by the engagement between the pin 20 and the groove 18. In FIGS. 2A to 2D, the cam carrier 12 rotates in a direction from an upper side to a lower side. For the purpose of explanation, FIGS. 2A to 2D show only the cam carrier 12, the solenoid actuator 24, and rocker arm rollers 26 that contact with the small-cams 14 or the large-cams 16. In FIG. 2A, the pins 20, 22 are drawn into the solenoid actuator 24. The pin 20 faces the groove 18*b*, and the pin 22 faces a portion where the groove 18 of the cam carrier 12 is not formed.

Figure 2B:
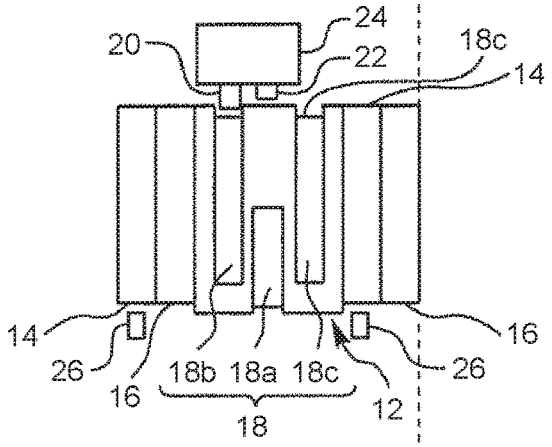

FIG. 2B illustrates an attitude of the cam carrier 12 after the cam carrier 12 rotates by 90° from the state shown in FIG. 2A. As can be seen from comparison between FIG. 2B and FIG. 2A, by the rotation of the cam carrier 12, the groove 18*a* moves to a far side, and the grooves 18*b*, 18*c* move to a near side. The grooves 18*b*, 18*c* illustrated in FIG. 2B are orthogonal to the axis of the cam carrier 12. Hereinafter, sites of the grooves 18*b*, 18*c* illustrated in FIG. 2B are referred to as "orthogonal sites". In FIG. 2B, the pin 20 is extruded from the solenoid actuator 24. The extruding operation of the pin 20 is performed while the pin 20 faces the orthogonal site of the groove 18*b*. The pin 20 extruded from the solenoid actuator 24 by the energization of the coil is inserted into the orthogonal site of the groove 18*b*, so that the pin 20 engages with the groove 18*b*.

Figure 2C:
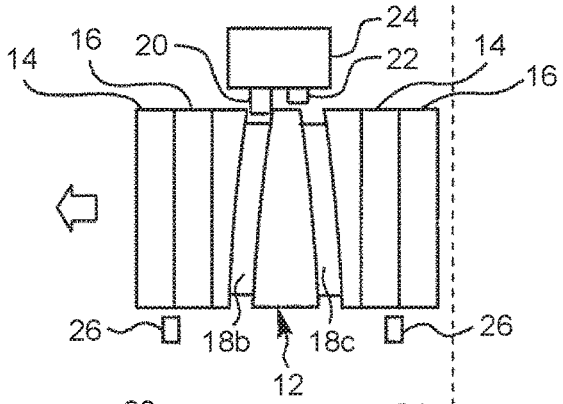

FIG. 2C illustrates an attitude of the cam carrier 12 after the cam carrier 12 rotates by 90° from the state shown in FIG. 2B. As can be seen from comparison between FIG. 2C and FIG. 2B, by the rotation of the cam carrier 12, the whole area of the groove 18*a* completely moves to the far side, and the grooves 18*b*, 18*c* further move to the near side. The grooves 18*b*, 18*c* illustrated in FIG. 2C are inclined with respect to the axis of the cam carrier 12. Sites of the grooves 18*b*, 18*c* illustrated in FIG. 2C are referred to as "inclined sites". As can be seen from comparison between FIG. 2C and FIG. 2B, the cam carrier 12 is slid to the left direction. This is because the orthogonal site and inclined site of the groove 18*b* move with the rotation of the cam carrier 12, while keeping the engagement with the pin 20.

Figure 2D:
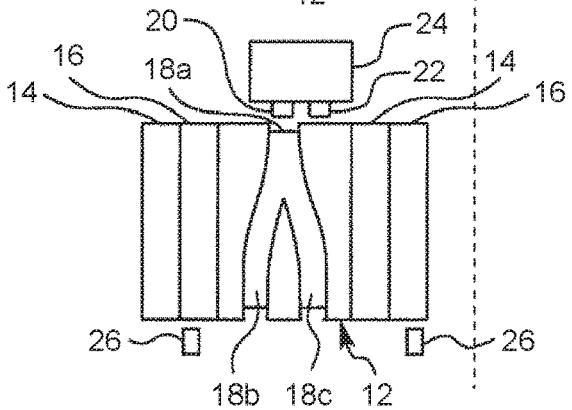

FIG. 2D illustrates an attitude of the cam carrier 12 after the cam carrier 12 rotates by 90° from the state shown in FIG. 2C. As can be seen from comparison between FIG. 2D and FIG. 2C, by the rotation of the cam carrier 12, the inclined sites of the grooves 18*b*, 18*c* move to the far side, and the groove 18*a* moves to the near side. In FIG. 2D, the pin 20 is drawn into the solenoid actuator 24. The drawing operation of the pin 20 is performed while the pin 20 faces the groove 18*a*. With the rotation of the cam carrier 12, the pin 20 engaging with the groove 18*a* reaches the small-depth end portion of the groove 18*a*. When the pin 20 moves on the small-depth end portion of the groove 18*a*, the pin 20 is pushed back to the solenoid actuator 24 side. When the pin 20 is pushed back, induced electromotive force is generated. By the detection of the induced electromotive force, the energization of the coil is cut off, so that the pin 20 is drawn into the solenoid actuator 24.

As can be seen from FIGS. 2A to 2D, when the cam carrier 12 is slid to the left direction, cams (that is, driving cams) that contact with the rocker arm rollers 26 are switched from the small-cams 14 to the large-cams 16.

A switching operation from the large-cams 16 to the small-cams 14 is performed as follows. The cam carrier 12 further rotates from the state shown in FIG. 2D, and the pin 22 is extruded from the solenoid actuator 24 while the pin 22 faces the orthogonal site of the groove 18*c*. Thereby, the pin 22 is inserted into the orthogonal site of the groove 18*c*. Then, the orthogonal site and inclined site of the groove 18*c* move while keeping the engagement with the pin 22. Therefore, the cam carrier 12 is slid to the right direction. When the pin 22 moves from the groove 18*c* to the groove 18*a* and reaches the small-depth end portion of the groove 18*a*, the pins 22 is pushed back to the solenoid actuator 24 side. When the pin 22 is pushed back, induced electromotive force is generated. By the detection of the induced electromotive force, the energization of the coil is cut off, so that the pin 22 is drawn into the solenoid actuator 24. In this way, the cams that contact with the rocker arm rollers 26 are switched from the large-cams 16 to the small-cams 14.

Back to FIG. 1, the description of the exemplary configuration of the system will be started again. The system shown in FIG. 1 includes an ECU 30 as a controller. The ECU 30 includes a RAM (random access memory), a ROM (read only memory), a CPU (microprocessor), and the like. The ECU 30 takes signals from various sensors that are mounted on a vehicle. The various sensors include a crank angle sensor 32 that outputs a signal corresponding to the rotational angle of the crankshaft. The various sensors include an ignition key 34 that outputs a signal (IG signal) for starting the engine and a signal (IG-OFF signal) for stopping the engine. The ECU 30 processes the signals taken from the various sensors, and operates various actuators in accordance with predetermined control programs. The various actuators include the above-described solenoid actuator 24. The various actuators also include a fuel injector 36 and an ignition device 38 that are provided in each cylinder of the engine. The various actuators also include a starter motor (starter) 40. The starter motor 40 is a well-known starting device that receives drive electric power from a battery (not illustrated) and rotates the crankshaft.

Figure 3:
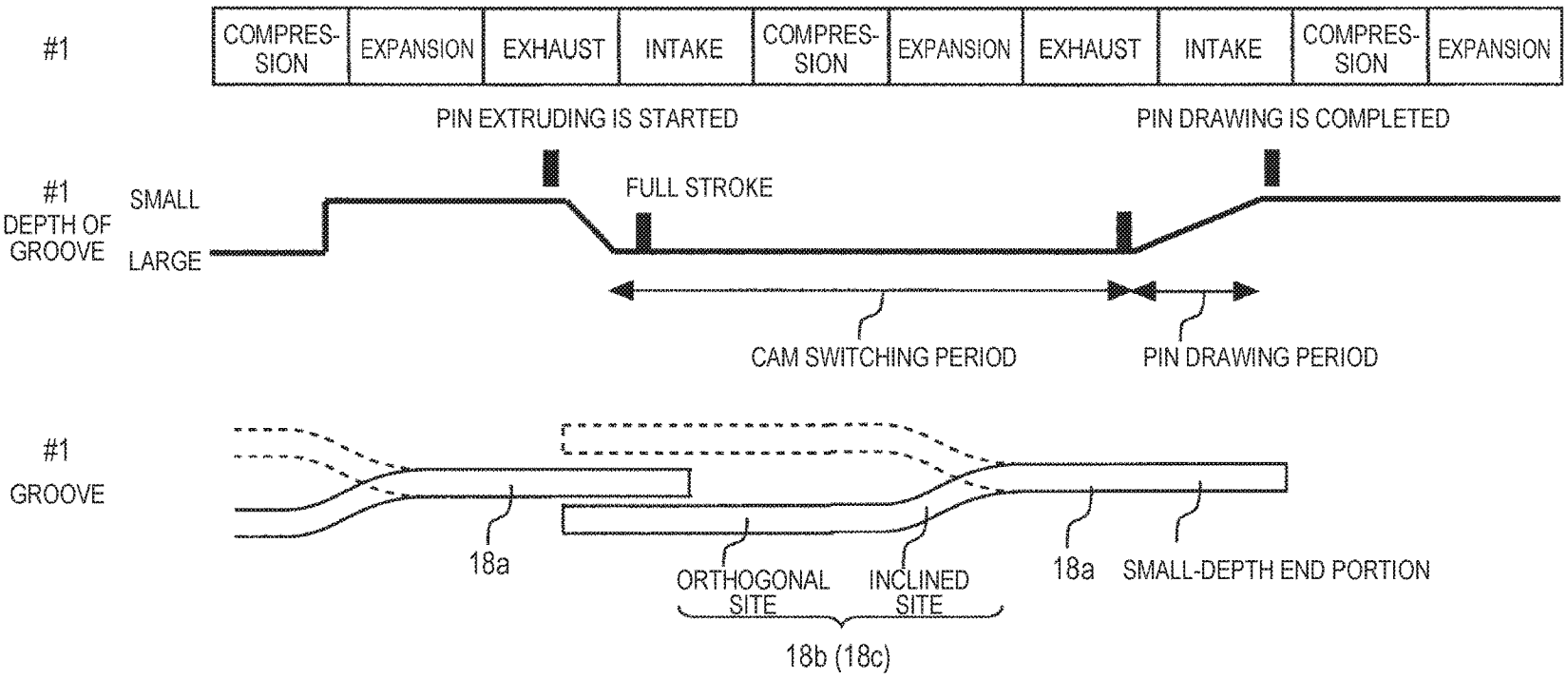
FIG. 3 is a diagram for describing an exemplary correspondence relation between a switching operation of a driving cam and four strokes of an engine.

In the first embodiment, at ordinary times of the engine (the time of the start of the engine is excluded; the same applies hereinafter), the small-cam is mainly used as the driving cam. On the other hand, at the time of the start of the engine, the large-cam is always used as the driving cam. FIG. 3 is a diagram for describing an exemplary correspondence relation between a switching operation of the driving cam and four strokes of the engine. In FIG. 3, a switching operation of the driving cam of the number one cylinder #1 is described. Basically, the same goes for switching operations of the driving cams of the number two cylinder #2 to the number four cylinder #4. The switching operation of the driving cam of the number one cylinder #1 is performed during one rotation of the camshaft (one rotation of the cam carrier). More specifically, the switching operation of the driving cam of the number one cylinder #1 is started in a middle period of an exhaust stroke shown on the left side of FIG. 3. The middle period of the exhaust stroke corresponds to a period just before the pin faces the orthogonal site of the groove 18*b* or the groove 18*c*. The extruding operation of the pin is started in this period.

The extruding operation of the pin is completed in an early period of an intake stroke shown on the left side of FIG. 3. The pin after the extruding operation is completed is in a full stroke state. The pin in the full stroke state contacts and engages with the orthogonal site of the groove 18*b* (or the groove 18*c*). From this state, the inclined site of the groove 18*b* (or the groove 18*c*) moves while keeping the engagement with the pin contacting with the orthogonal site of the groove 18*b* (or the groove 18*c*). Then, in an early period of an exhaust stroke, the pin engages with the groove 18*a*. A period after the pin becomes the full stroke state and before the pin engages with the groove 18*a* corresponds to a switching period of the driving cam. Then, a drawing operation of the pin is started in a latter period of the exhaust stroke shown on the right side of FIG. 3. The latter period of the exhaust stroke corresponds to a period during which the pin is reaching the small-depth end portion of the groove 18*a* described in FIG. 2D. The drawing operation of the pin is completed in a latter period of an intake stroke shown on the right side of FIG. 3. Thereby, the switching operation of the driving cam of the number one cylinder #1 is completed.

In the system that uses mainly the small-cam at ordinary times of the engine, it is expected that the small-cam is frequently selected as the driving cam when a stop request for the engine (which means a stop request for the drive of the fuel injector and the ignition device; the same applies hereinafter) is output. Hence, in the first embodiment, when the stop request for the engine is output, it is determined whether a cylinder (hereinafter, referred to as a "small-cam cylinder") for which the small-cam is selected as the driving cam is included. Then, in the case where it is determined that the small-cam cylinder is included, a switching command for switching the driving cam from the small-cam to the large-cam is output. Hereinafter, such a control at the time of the stop of the engine is referred to as a "stop-time control". In the stop-time control in the first embodiment, the switching command for switching the driving cam from the small-cam to the large-cam is output to all solenoid actuators.

However, since the stop request for the engine is output, the rotation of the camshaft is stopped even during the stop-time control. When the rotation of the camshaft is stopped during the stop-time control, there is a possibility that the switching operation of the driving cam based on the above-described switching command is not completed for some cylinders. That is, there is a possibility of a failure of the switching operation of the driving cam based on the above-described switching command. According to the first embodiment, which gives preference to the stop of the engine over the execution of the stop-time control, it is possible to reduce fuel consumption, compared to a case of extending the stop of the engine while giving preference to the execution of the stop-time control. On the other hand, when the engine is started in a state where the failure of the switching operation has occurred, there is a possibility that the combustion state worsens in the small-cam cylinder. Further, there is also a possibility that the combustion state varies among the cylinders due to unequal driving cams of the cylinders.

Hence, in the first embodiment, when a start request for the engine is output, a determination having the same content as the content of the above-described determination is performed again. Then, in the case where it is determined that the small-cam cylinder is included, the above-described switching command is output to all solenoid actuators again. In addition, the drive of the fuel injector is suspended until the switching operation of the driving cam is completed for all cylinders. Hereinafter, such a control at the time of the start of the engine is referred to as a "start-time control".

Figure 4:
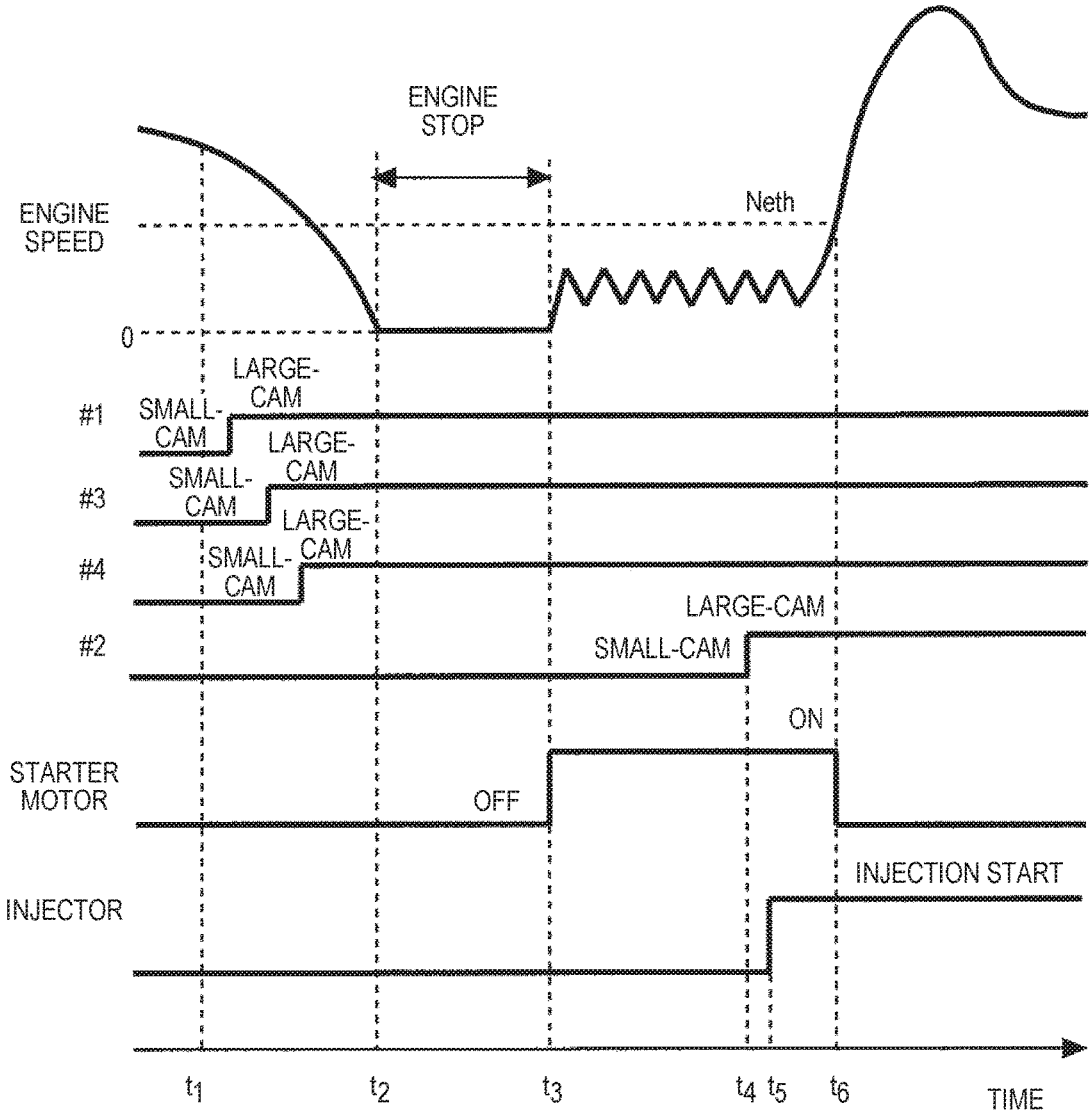
FIG. 4 is a diagram for describing an exemplary stop-time control and an exemplary start-time control in the first embodiment of the disclosure.

FIG. 4 is a diagram for describing an exemplary stop-time control and an exemplary start-time control in the first embodiment of the disclosure. In the example of FIG. 4, the stop request for the engine is output at time $t_1$, and the engine speed becomes zero at time $t_2$. The switching of the driving cams of the number one cylinder #1, the number three cylinder #3 and the number four cylinder #4 is performed in a period from time $t_1$ to time $t_2$. However, the switching of the driving cam of the number two cylinder #2 is not completed. That is, the number two cylinder #2 is a small-cam cylinder. Hence, the switching of the driving cam of the number two cylinder #2 is performed after time $t_3$. Time $t_3$ is a time when the drive of the starter motor is started in response to the start request for the engine. By the drive of the starter motor, the cam carrier is rotated in synchronization with the rotation of the crankshaft. Therefore, by outputting the above-described switching command after time $t_3$, the switching of the driving cam of the number two cylinder #2 is completed at time $t_4$.

When the switching of the driving cam of the number two cylinder #2 is completed, the switching of the driving cams of all cylinders is completed. In the example of FIG. 4, an injection permission for each injector is output at time $t_4$, and the injection of fuel is actually started after time $t_5$. In other words, the injection of fuel from each injector is suspended until time $t_4$. Thus, in the start-time control, during the drive of the starter motor, the start of the combustion of air-fuel mixture in each cylinder is suspended until the switching of the driving cams of all cylinders is completed. Accordingly, it is possible to prevent the above-described problems relevant to the combustion state, before the problems occur. The engine speed is increased by a torque to be supplied from the starter motor and a torque to be generated by the combustion of the air-fuel mixture. The drive of the starter motor is stopped at time $t_6$ when the engine speed reaches a threshold Neth.

In the example of FIG. 4, the above-described switching command is output to all solenoid actuators. Therefore, the extruding operation of the pin is performed not only in the number two cylinder #2 but also in the other cylinders for which the switching of the driving cams is completed.

However, in each of the cylinders other than the number two cylinder #2, the pin extruded from the solenoid actuator faces a surface of the cam carrier 12 positioned between the orthogonal site of the groove 18*b* and the orthogonal site of the groove 18*c*, which have been described in FIGS. 2A to 2D. Even when the cam carrier 12 shown in FIGS. 2A to 2D is rotated, the extruded pin is inserted into the groove 18*a*. Thereafter, the pin is pushed by the small-depth end portion of the groove 18*a*, and is pushed back to the solenoid actuator side. Therefore, the cam carriers of the cylinders other than the number two cylinder #2 are not slid, and only the cam carrier of the number two cylinder #2 is slid.

When the pin is pushed back to the solenoid actuator side, the above-described induced electromotive force is generated, and the energization of the coil is cut off. Therefore, similarly to the extruding operation of the pin, the drawing operation of the pin is performed for all cylinders.

Figure 5:
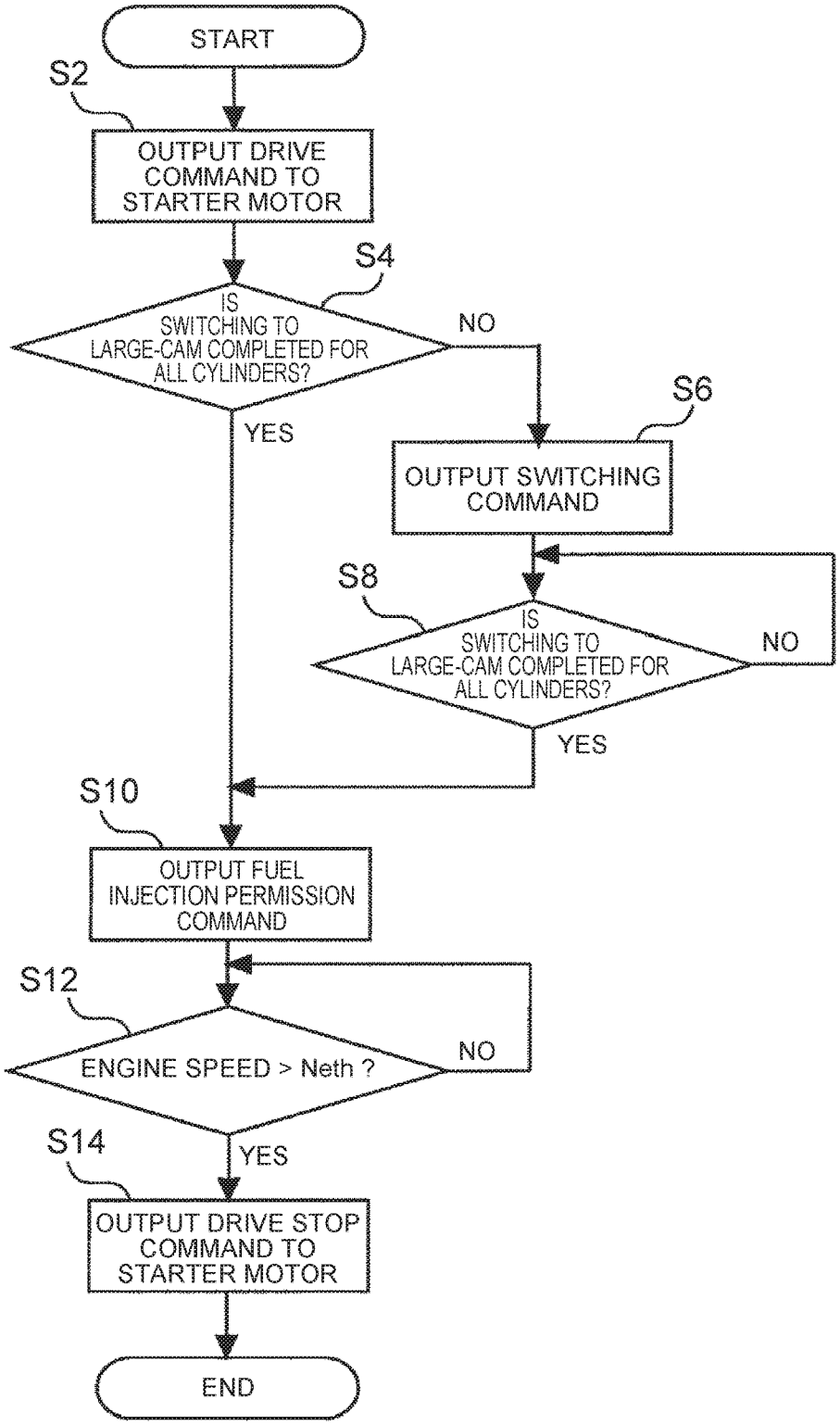
FIG. 5 is a diagram showing an exemplary processing routine relevant to the start-time control that is executed by an ECU in the first embodiment of the disclosure.

FIG. 5 is a diagram showing an exemplary processing routine relevant to the start-time control that is executed by the ECU in the first embodiment of the disclosure. The routine is executed whenever the start request for the engine is output. Whether the start request is output is determined, for example, based on whether the ECU receives the IG signal from the ignition key 34 shown in FIG. 1. The IG signal is a signal that is output when a predetermined operation (for example, an operation of turning the ignition key to a predetermined position) is performed by a driver of the vehicle.

In the routine shown in FIG. 5, first, a drive command is output to the starter motor (step S2). Subsequently, it is determined whether the driving cam has been switched to the large-com for all cylinders (step S4). The determination in step S4 is performed using the detection result of the generation of the induced electromotive force in the stop-time control that is performed just before the execution of the routine. Specifically, in the case where the generation of the induced electromotive force has been detected in all solenoid actuators, it is determined that the driving cam has been switched to the large-cam for all cylinders. On the other hand, in the case where the generation of the induced electromotive force has not been detected in any one of the solenoid actuators, it is determined that the failure of the switching of the driving cam in the stop-time control has occurred.

In the case where the determination in step S4 is negative, it is determined that the small-cam cylinder is included. Therefore, the above-described switching command is output to all solenoid actuators (step S6). Subsequently, it is determined whether the driving cam has been switched to the large-cam for all cylinders (step S8). The determination in step S8 is performed using the detection result of the induced electromotive force that is generated based on the switching command output in step S6. Specifically, in the case where the generation of the induced electromotive force has been detected for all solenoid actuators, it is determined that the driving cam has been switched to the large-cam for all cylinders. The process in step S8 is repeated until the positive determination result is obtained.

In the case where the determination in step S4 or step S8 is positive, it is determined that the small-cam cylinder is not included. Therefore, a command for permitting the injection from the fuel injector is output (step S10). Subsequently, it is determined whether the engine speed is exceeding a threshold Neth (step S12). The process in step S12 is repeated until the positive determination result is obtained. In the case where the determination in step S12 is positive, a drive stop command is output to the starter motor (step S14).

Thus, according to the routine shown in FIG. 5, when the start request for the engine is output, it is possible to equalize the driving cams of all cylinders to the large-cam, by the start of fuel injection. Therefore, it is possible to prevent the above-described problems relevant to the combustion state, before the problems occur. Further, according to the routine shown in FIG. 5, no matter what the detection result of the induced electromotive force in the stop-time control is, it is possible to equalize the driving cams of all cylinders to the large-cam, by the start of the fuel injection at the time of the subsequent engine start. That is, regardless of the mode of the engine stop at the time of the previous stop, it is possible to equalize the driving cams of all cylinders to the large-cam, by the start of the fuel injection at the time of the current engine start.

In the first embodiment, the solenoid actuator corresponds to an example of the "switching mechanism". The ECU corresponds to an example of the "controller". The large-cam corresponds to an example of the "start cam".

Next, a second embodiment of the disclosure will be described with reference to FIG. 6. An exemplary configuration of a system in the second embodiment is similar to the exemplary configuration shown in FIG. 1. Further, the switching operation of the driving cam has been described in FIGS. 2A to 2D and FIG. 3. Accordingly, descriptions about the exemplary configuration of the system and the switching operation of the driving cam are omitted.

In the first embodiment, the stop-time control is executed, and the start-time control is executed depending on the determination result relevant to the small-cam cylinder when the stop request for the engine is output. Further, in the execution of the start-time control, the switching command output at the time of the stop-time control is output to all solenoid actuators, again. In the second embodiment, the stop-time control having the same content as that in the first embodiment is executed, and the start-time control is executed depending on the determination result relevant to the above-described small-cam cylinder. However, in the execution of the start-time control in the second embodiment, the switching command output at the time of the stop-time control is output to only a solenoid actuator corresponding to the small-cam cylinder, again.

As described in step S4 of FIG. 5 in the first embodiment, the determination about the failure of the switching of the driving cam is performed using the detection result of the generation of the induced electromotive force in the stop-time control. Since the detection result is obtained separately from each solenoid, it is found what cylinder corresponds to the small-cam cylinder, at the end time of the stop-time control. The above-described energization of the coil is performed separately in each solenoid. Since the above-described switching command is output to only the solenoid actuator corresponding to the small-cam cylinder, the above-described switching command is not output to the other solenoid actuators. Therefore, according to the start-time control in the second embodiment, it is possible to avoid some coils from being energized. Therefore, it is possible to reduce the electric power consumption for the execution of the start-time control, compared to the first embodiment.

Figure 6:
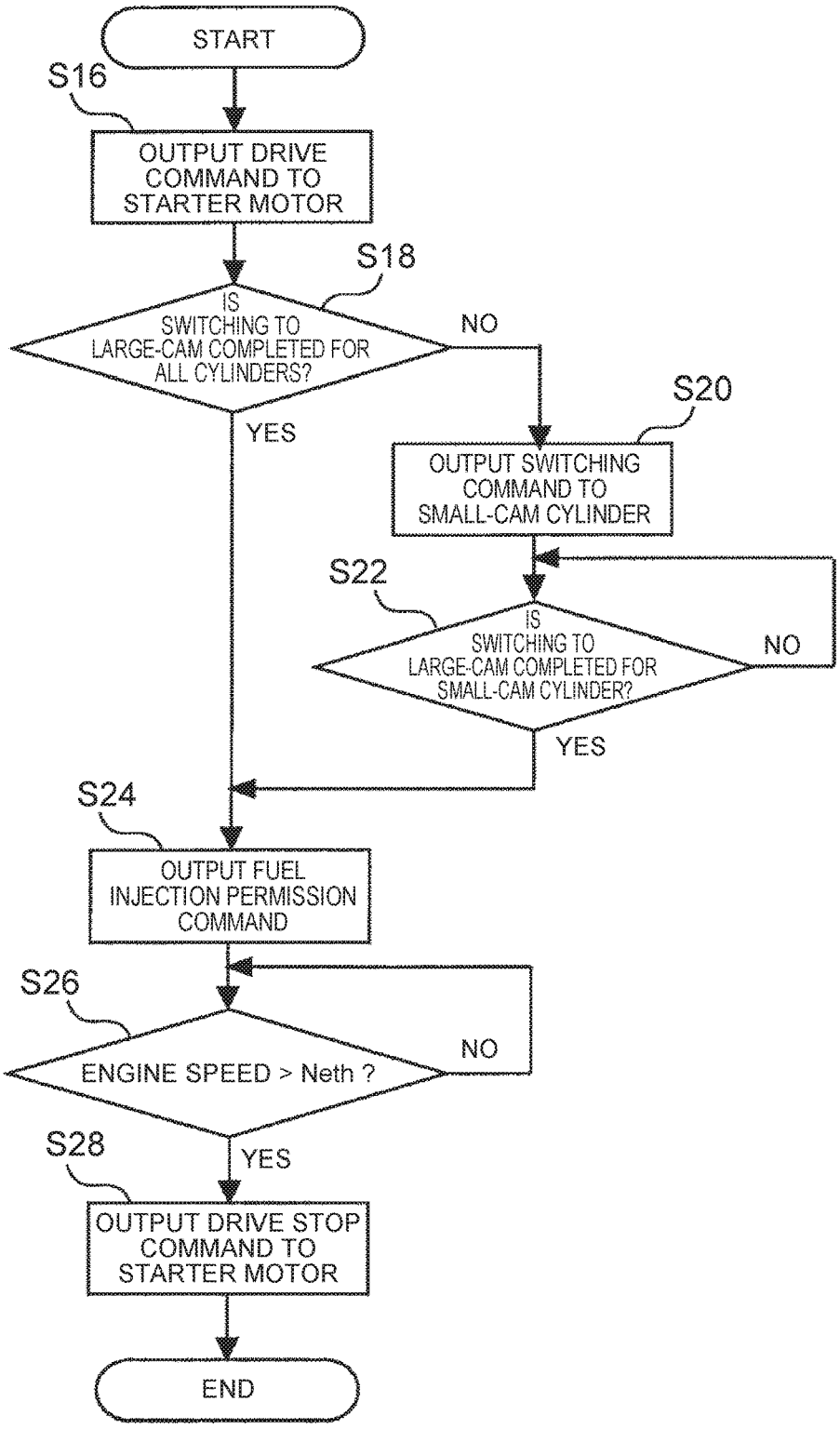
FIG. 6 is a diagram showing an exemplary processing routine relevant to the start-time control that is executed by the ECU in a second embodiment of the disclosure.

FIG. 6 is a diagram showing an exemplary processing routine relevant to the start-time control that is executed by the ECU in the second embodiment of the disclosure. The routine is executed whenever the start request for the engine is output, similarly to the routine shown in FIG. 5. The processes shown in the routine is basically the same as the processes in the routine shown in FIG. 5. Specifically, the processes in steps S16, S18, S24, S26 and S28 of FIG. 6 are the same as the processes in steps S2, S4, S10, S12 and S14 of FIG. 5. In the following, the processes in steps S20 and S22 of FIG. 6, which are partially different from the processes in FIG. 5, will be described.

In step S20 of FIG. 6, the above-described switching command is output to a solenoid actuator corresponding to the small-cam cylinder. As described above, it is found what cylinder is the small-cam cylinder, at the end time of the stop-time control. In the process in step S20, the small-cam cylinder is specified based on that information, and the above-described switching command is output. Subsequently, it is determined whether the driving cam of the small-cam cylinder has been switched to the large-cam (step S22). The determination in step S22 is performed using the detection result of the induced electromotive force that is generated based on the switching command output in step S20. Specifically, in the case where the generation of the induced electromotive force has been detected in the solenoid actuator corresponding to the small-cam cylinder, it is determined that the driving cam of the small-cam cylinder has been switched to the large-cam. The process in step S22 is repeated until the positive determination result is obtained.

Thus, according to the routine shown in FIG. 6, in the case where the small-cam cylinder is included, it is possible to switch the driving cam of the small-cam cylinder to the large-cam, by the start of fuel injection. Therefore, it is possible to reduce the electric power consumption for the execution of the start-time control, compared to the first embodiment.

Next, a third embodiment of the disclosure will be described with reference to FIGS. 7 and 8. An exemplary configuration of a system in the third embodiment is an exemplary configuration in which a motor generator (not illustrated) is added to the configuration shown in FIG. 1. The motor generator is configured by a permanent magnet type alternating-current synchronous motor, as an example. A rotational shaft of the motor generator is linked with the crankshaft. The motor generator gives a motor torque generated by powering drive, to the crankshaft. The motor generator operates also as an electric generator, by regenerative drive. Constituents other than the motor generator are the same as those in the exemplary configuration shown in FIG. 1. Further, the switching operation of the driving cam has been described in FIGS. 2A to 2D and FIG. 3. Accordingly, descriptions about the exemplary configuration of the system and the switching operation of the driving cam are omitted.

In the first embodiment, the stop-time control is executed, and the start-time control is executed depending on the determination result relevant to the small-cam cylinder when the stop request for the engine is output. In the third embodiment, the stop-time control and start-time control having the same contents as those in the first embodiment are executed. However, in the third embodiment, there is executed a control to perform a powering drive of the motor generator during a period when the engine is stopped, based on the information about the small-cam cylinder that is found at the end time of the stop-time control. Hereinafter, such a control during a period when the engine is stopped is referred to as a "during-stop control".

Figure 7:
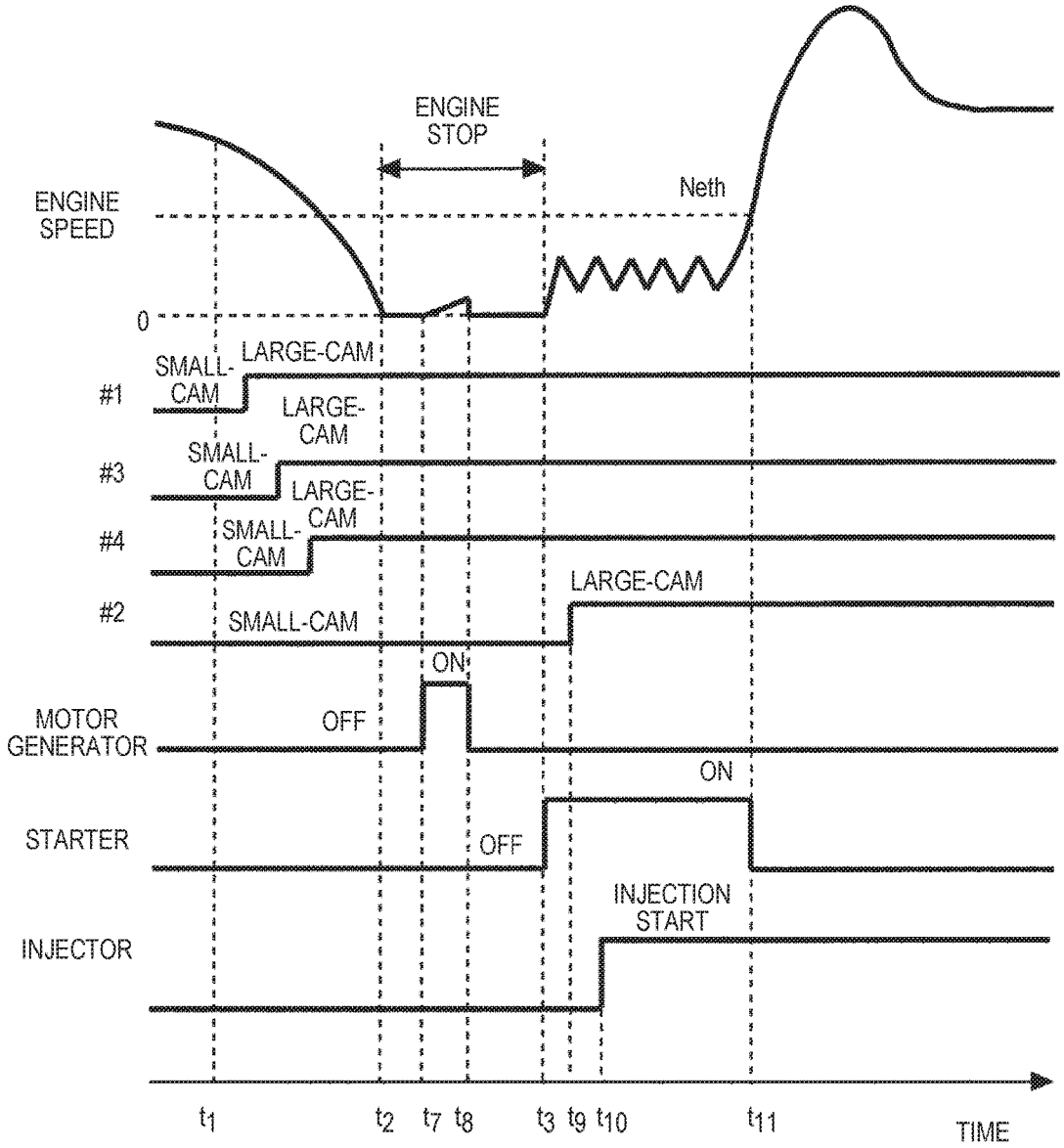
FIG. 7 is a diagram for describing an exemplary during-stop control in a third embodiment of the disclosure.

FIG. 7 is a diagram for describing an exemplary during-stop control in the third embodiment of the disclosure. In the example of FIG. 7, the stop request for the engine is output at time $t_1$, and the engine speed becomes zero at time $t_2$. The switching of the driving cams of the number one cylinder #1, the number three cylinder #3 and the number four cylinder #4 is performed in a period from time $t_1$ to time $t_2$. However, the switching of the driving cam of the number two cylinder #2 is not completed. So far, the content of the stop-time control is the same as the content of the stop-time control described in FIG. 4.

At time $t_2$, it is found that the number two cylinder #2 corresponds to the small-cam cylinder. Hence, in the example of FIG. 7, at time $t_7$ after time $t_2$, the powering drive of the motor generator is started, and the crankshaft is rotated. By the rotation of the crankshaft, the stop position of the cam carrier is moved. In the example of FIG. 7, the drive of the motor generator is continued until time $t_8$ with reference to positional information from the crank angle sensor, such that the extruding operation of the pin of the number two cylinder #2 after time $t_3$ is started ahead of the switching operations of the other cylinders. That is, the powering drive of the motor generator is performed from time $t_7$ to time $t_8$, such that the order of the extruding operation of the pin of the number two cylinder #2 is advanced.

By the execution of the during-stop control, it is possible to complete the switching of the driving cam of the number two cylinder #2, at time $t_9$. When the injection permission for each injector is output at time $t_9$, the injection of fuel is actually started after time $t_{10}$. If the advance of the order of the number two cylinder #2 is not performed, there is a possibility that the start of the fuel injection by the execution of the start-time control is delayed. In contrast, when the stop-time control is executed, it is possible to shorten the delay time to the start of fuel injection, and to increase the engine speed in a short time. The drive of the starter motor is stopped at time $t_{ii}$ when the engine speed reaches the threshold Neth.

Figure 8:
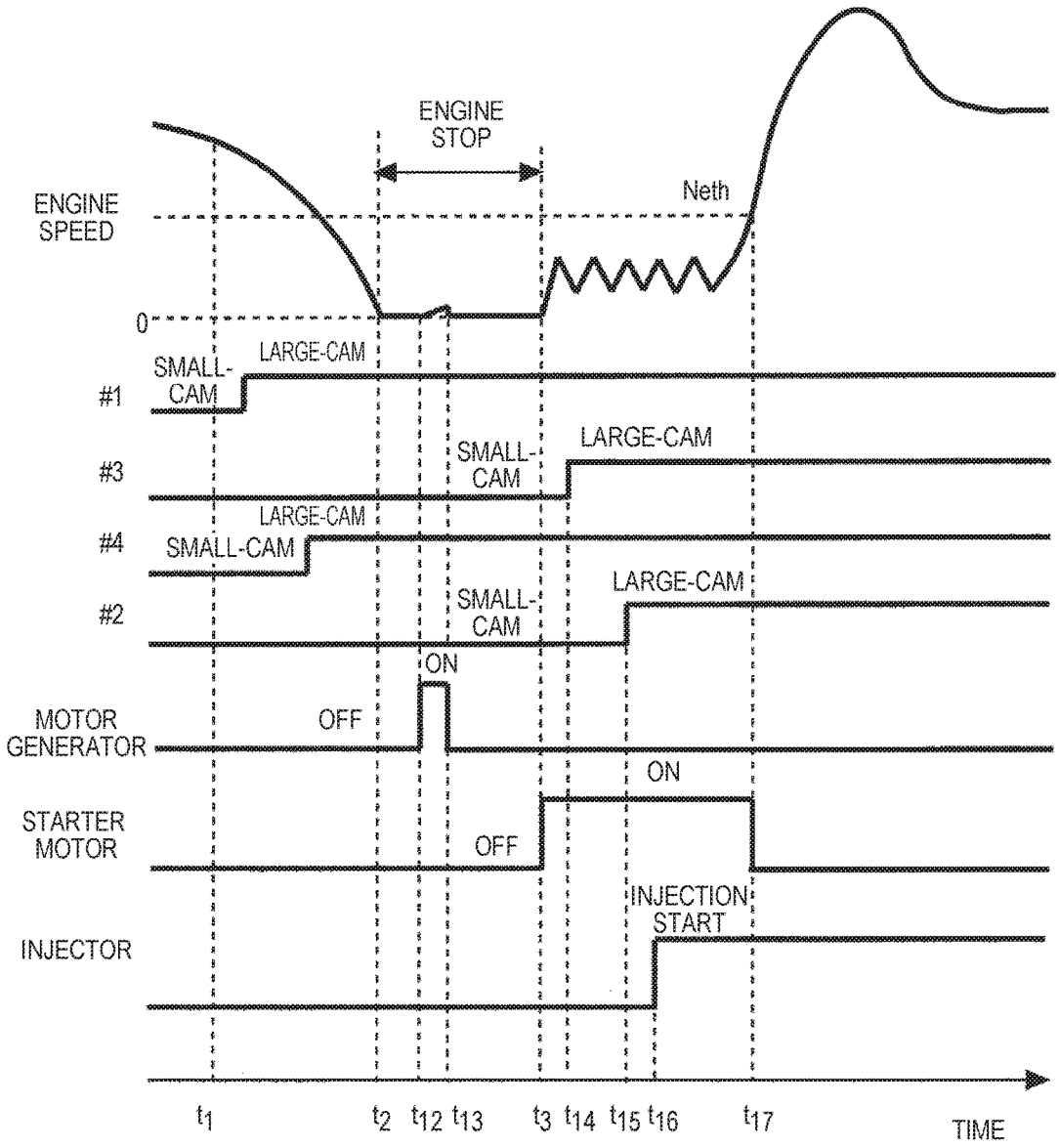
FIG. 8 is a diagram for describing another exemplary during-stop control in the third embodiment of the disclosure.

FIG. 8 is a diagram for describing another exemplary during-stop control in the third embodiment of the disclosure. In the example of FIG. 8, the stop request for the engine is output at time $t_1$, and the engine speed becomes zero at time $t_2$. So far, the content of the stop-time control is the same as the content of the stop-time control described in FIG. 4.

In the example of FIG. 8, the switching of the driving cams of the number one cylinder #1 and the number four cylinder #4 is performed in a period from time $t_1$ to time $t_2$. However, the switching of the driving cams of the number two cylinder #2 and the number three cylinder #3 is not completed. At time $t_2$, it is found that the number two cylinder #2 and the number three cylinder #3 correspond to the small-cam cylinder. Hence, in the example of FIG. 8, at time $t_{12}$ after time $t_2$, the powering drive of the motor generator is started, and the crankshaft is rotated. By the rotation of the crankshaft, the stop position of the cam carrier is moved. In the example of FIG. 8, the drive of the motor generator is continued until time $t_{13}$ with reference to positional information from the crank angle sensor, such that the extruding operation of the pin of the number three cylinder #3 after time $t_3$ is firstly started and the extruding operation of the pin of the number two cylinder #2 is thirdly started.

By the execution of the during-stop control, it is possible to complete the switching of the driving cam of the number three cylinder #3 at time $t_{14}$, and to complete the switching of the driving cam of the number two cylinder #2 at time $t_{15}$. That is, it is possible to complete the switching of the driving cams of all cylinders at time $t_{15}$. When the injection permission for each injector is output at time $t_{15}$, the injection of fuel is actually started after time $t_{16}$. As described in the example of FIG. 7, if the advance of the orders of the number two cylinder #2 and the number three cylinder #3 is not performed, there is a possibility that the start of the fuel injection by the execution of the start-time control is delayed. In contrast, when the stop-time control is executed, it is possible to shorten the delay time to the start of fuel injection, and to increase the engine speed in a short time. The drive of the starter motor is stopped at time $t_{17}$ when the engine speed reaches the threshold Neth.

In the third embodiment, the motor generator corresponds to an example of the "electric motor".

Incidentally, in the examples described in the first to third embodiments, the four cam carriers 12 are disposed on the camshaft 10 shown in FIG. 1. That is, in the examples, the cam carrier 12 is disposed for each cylinder. However, the cam carrier 12 may be disposed across two or more cylinders. An example of the disposition is disclosed in Japanese Patent Application Publication No. 2009-228543. That is, regardless of the configuration of the cam carrier that is employed, the above-described stop-time control, start-time control and during-stop control can be applied, if the switching of the cam using the slide of the cam carrier is not performed for all cylinders collectively but is performed separately in each corresponding cylinder or in each corresponding cylinder group.

Further, in the examples described in the first to third embodiments, the driving cam at ordinary times of the engine is mainly the small-cam, and the driving cam at the time of the start of the engine is the large-cam. However, the relation between the operation state and driving cam of the engine is just one example. The driving cam at ordinary times of the engine may be mainly the large-cam, and the driving cam at the time of the start of the engine may be the small-cam. That is, even in the case where the driving cam at the time of the start of the engine is the small-cam, the above-described stop-time control, start-time control and during-stop control can be applied. Moreover, candidates of the driving cam of the cam carrier are not limited to the two kinds: the small-cam and the large-cam, and three or more kinds of candidates of the driving cam may be adopted. Even in such a case, the above-described stop-time control, start-time control and during-stop control can be applied, when the driving cams of all cylinders are equalized to a particular start cam at the time of the start of the engine.

In the first to third embodiments, whether the failure of the switching of the driving cam has occurred is determined using the detection result of the induced electromotive force when the pin is pushed back to the solenoid actuator side. Further, in the second embodiment, the detection result is used for specifying the small-cam cylinder. However, there may be separately provided a sensor that detects the intake cam facing the rocker arm roller, and the sensor may be used for the determination of the above-described failure and the specification of the small-cam cylinder.

In the third embodiment, the stop-time control and start-time control having the same contents as those in the first embodiment are executed. However, in the third embodiment, the start-time control in the second embodiment may be executed instead of the start-time control in the first embodiment.

In the first to third embodiments, in the start-time control, the drive of the fuel injector is suspended until the switching operation of the driving cam is completed for all cylinders. However, the drive of the ignition device may be suspended instead of the drive of the fuel injector or in addition to the drive of the fuel injector. By suspending the drive of the ignition device, it is possible to suspend at least the combustion of air-fuel mixture in each cylinder, and therefore, it is possible to prevent the above-described problems relevant to the combustion state, before the problems occur. From a standpoint of the reduction in fuel consumption, it is preferable to suspend not the drive of the ignition device but the drive of the fuel injector.

What is claimed is:

1. An internal combustion engine system comprising:

an internal combustion engine that includes a plurality of cylinders;

a plurality of kinds of cams that have different cam profiles, each of the plurality of kinds of cams being configured to be capable of driving an intake valve that is provided for each of the plurality of cylinders of the internal combustion engine;

a plurality of hollow shafts, each of the plurality of hollow shafts being configured to support the plurality of kinds of cams provided for a corresponding one of the plurality of cylinders or to support the plurality of kinds of cams provided for a corresponding one of cylinder groups, the plurality of hollow shafts being provided on a camshaft which rotates in synchronization with a crankshaft of the internal combustion engine;

a plurality of solenoid actuators, each of the plurality of solenoid actuators being respectively provided for a corresponding one of the plurality of hollow shafts, the plurality of solenoid actuators switching driving cams among the plurality of kinds of cams, each of the driving cams being a cam that actually drives the intake valve; and a controller including a processor configured to:

i) output a switching command, for performing switching of each of the driving cams of each cylinder to a predetermined start cam, to the plurality of solenoid actuators at a time of a stop of the internal combustion engine;

ii) output the switching command to the plurality of solenoid actuators, when a failure of the switching to the predetermined start cam has occurred, at a time of a next start of the internal combustion engine; and iii) suspend a start of combustion of air-fuel mixture in each cylinder, until the performing switching of each of the driving cams is completed for all cylinders, wherein the plurality of solenoid actuators respectively slide the plurality of hollow shafts in an axial direction of the camshaft in order, by extruding pins capable of engaging with the plurality of hollow shafts.

2. The internal combustion engine system according to claim 1, wherein the controller is configured to specify a specified cylinder or a specified cylinder group at the time of the stop of the internal combustion engine and output the switching command only to the solenoid actuator provided corresponding to the specified cylinder or the specified cylinder group at the time of the next start of the internal combustion engine, the specified cylinder being a cylinder that has failed to switch to the predetermined start cam, the specified cylinder group being a cylinder group that includes a cylinder that has failed to switch to the predetermined start cam.

3. The internal combustion engine system according to claim 1, further comprising an electric motor that rotates the crankshaft, wherein the controller is configured to specify a specified cylinder or a specified cylinder group at the time of the stop of the internal combustion engine and control the electric motor during a period when the internal combustion engine is stopped such that an order for the specified cylinder or the specified cylinder group is advanced, the order being an order of the switching to the predetermined start cam at the time of the next start of the internal combustion engine, the specified cylinder being a cylinder that has failed to switch to the predetermined start cam, the specified cylinder group being a cylinder group that includes a cylinder that has failed to switch to the predetermined start cam.

* * * * *